US005772461A

United States Patent [19]

Yu

[11] Patent Number: 5,772,461

[45] Date of Patent: Jun. 30, 1998

[54] LOCKING MECHANISM FOR INTERCONNECTING TWO MATED CONNECTORS

[75] Inventor: Nobbert N. H. Yu, Tao-Yuan Hsien, Taiwan

[73] Assignee: Hon Hai Precision Ind. Co., Ltd., Taiwan

[21] Appl. No.: 713,773

[22] Filed: Sep. 13, 1996

[51] Int. Cl.[6] ..... H01R 13/627

[52] U.S. Cl. ..... 439/352

[58] Field of Search ..... 439/352, 353, 439/354, 357, 358, 609, 610

[56] References Cited

U.S. PATENT DOCUMENTS 4,657,331 4/1987 Coldren ..... 439/357

*Primary Examiner*—Neil Abrams
*Assistant Examiner*—Yong Ki Kim

[57] ABSTRACT

A first receptacle connector includes a first main body having a first projecting section on the front portion, and a second plug connector includes a second main body having a second projecting section on the front portion wherein a hook device is provided on the first projecting section of the first receptacle connector and a locking slot is provided on the second projecting section of the second plug connector, and said second projecting section of the second plug connector further includes a release device which can incorporate the hook device of the first projecting section of the first receptacle connector to unhook the engagement between the hook of the first projecting section of the first receptacle and the locking slot of the second projecting section of the second plug connector.

8 Claims, 4 Drawing Sheets

LOCKING MECHANISM FOR INTERCONNECTING TWO MATED CONNECTORS

BACKGROUND OF THE INVENTION

1. Field of the Invention

The invention relates to two mated connectors, and particularly to locking mechanism thereof for interconnecting such two coupled connectors.

2. The Related Art

To retain two coupled connector together, different methods have been tried. For example, U.S. Pat. No. 5,021,004 uses locking ejectors on the host connector for latchable engagement with the counterpart connector; U.S. Pat. Nos. 5,178,556 and 5,178,557 use hook devices to cooperatively fasten to each other. Additional example is depicted in FIGS. 1(A) and 1(B) wherein the host connector 1, which is mounted on the panel 2, is adapted to cope with cable connector 3. The cable connector 3 includes two pairs of engaging apertures 4 and the host connector 3 includes two pairs of deflectable tangs 5 each with a dimple portion 6 adapted to be received within the corresponding aperture 4 in the cable connector 3 when this two connectors 1 and 3 are mated fully with each other, thereby restraining these two connectors 1 and 3 from moving away from each other in the lengthwise direction.

The aforementioned different retention ways for combination of two complementary connectors have their own respective features based on the corresponding connectors' basic structures. Some can use less space but lack sufficient reliable latching performance, as shown in FIGS. 1 (A) and 1(B).

Therefore, an object of the invention is to provide combination mechanism for retaining two mutual counterpart connectors together wherein the basic structures of the connectors are generally in a similar form of what is shown in FIGS. 1(A) and 1(B) but the locking function is superior to that of connectors shown in FIGS. 1(A) and 1(B).

SUMMARY OF THE INVENTION

According to an aspect of the invention, a first receptacle connector includes a first main body having a first projecting section on the front portion, and a second plug connector includes a second main body having a second projecting section on the front portion wherein a hook device is provided on the first projecting section of the first receptacle connector and a locking slot is provided on the second projecting section of the second plug connector, and said second projecting section of the second plug connector further includes a release device which can incorporate the hook device of the first projecting section of the first receptacle connector to unhook the engagement between the hook of the first projecting section of the first receptacle connector and the locking slot of the second projecting section of the second plug connector.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 2:
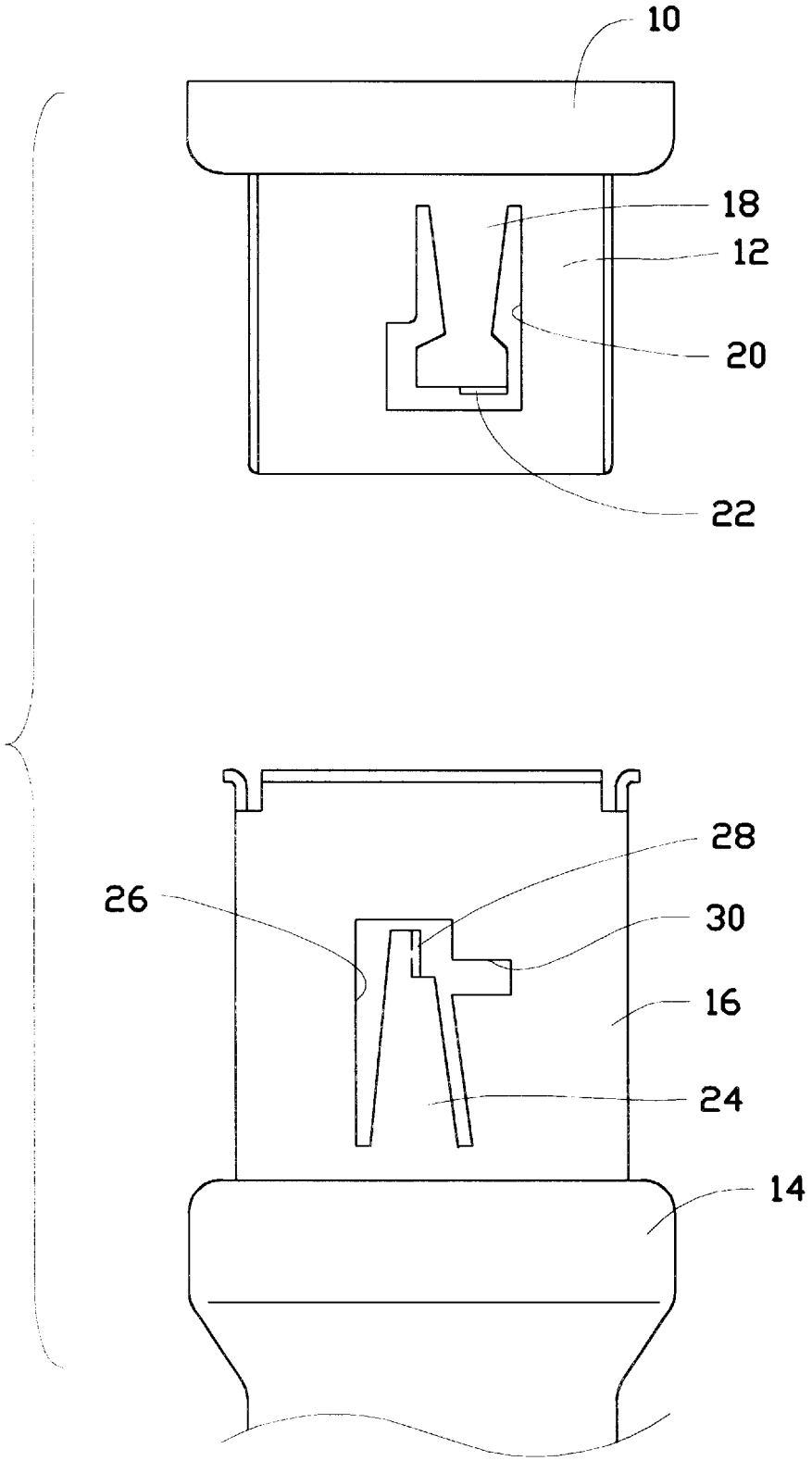
FIG. 2 is a partial top view of a presently preferred embodiment of a receptacle connector and a plug connector, separated from each other, according to the invention.
Figure 3:
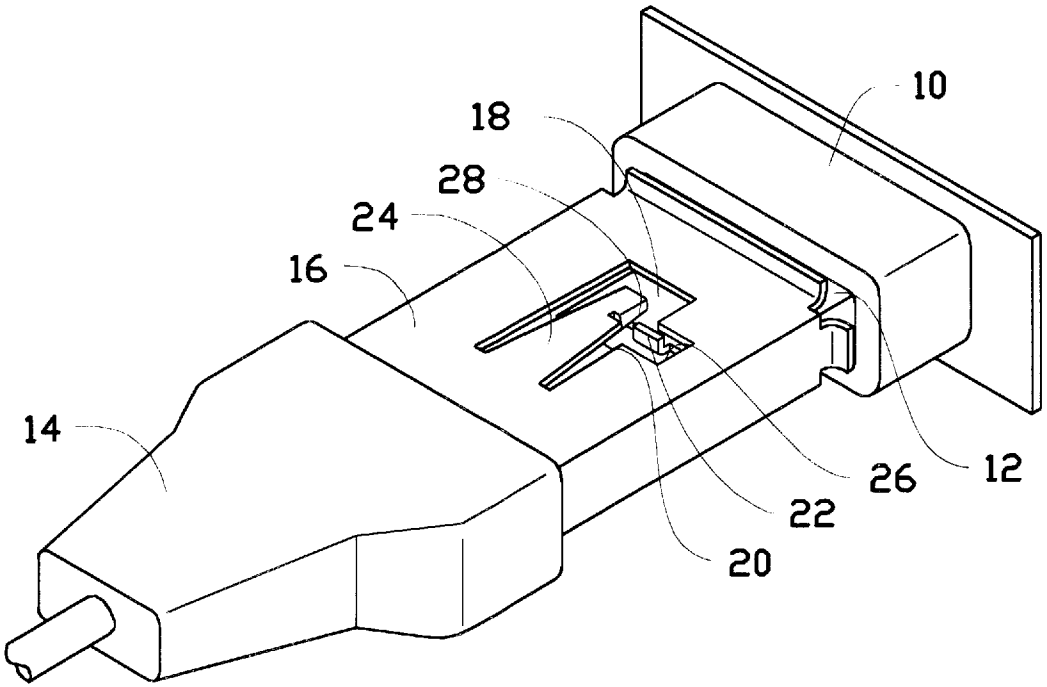
FIG. 3 is a perspective view of the mated receptacle and plug connectors of FIG. 2.

It will be noted here that for a better understanding, most of like components are designated by like reference numerals throughout the various figures in the embodiments. Attention is directed to FIGS. 2 and 3 wherein a receptacle connector 10 includes a shielding projecting section 12 which is generally of a rectangular cross-sectional shape and the contacts (not shown) are disposed within the contour of the projecting section 12. Correspondingly, a plug connector 14 includes another shielding projecting section 16 which is also of a rectangular form but with a somewhat larger dimension in comparison with the projecting section 12 of the receptacle connector 10 so that the projecting section 12 of the receptacle connector 10 can be received within the projecting section 16 of the plug connector 14 when this two connector 10 and 14 are mated.

The projecting section 12 of the receptacle connector 10 includes a first inwardly deflectable tang 18 suspensibly extending, in a mating direction of the two connectors 10 and 14, in an opening 20 in the projecting section 12 of the receptacle connector 10 wherein a vertical upward projecting tag 22 is provided at the distal end thereof. Correspondingly, a second inwardly deflectable tang 24 suspensibly extends, in same mating direction of the two connectors 10 and 14, in an opening 26 in the projecting section 16 of the plug connector 14 wherein a downward projecting tag 28 integrally formed on a distal end of the tang 24, whereby when these two connectors 10, 14 are mated with each other, the upward tag 22 of the tang 18 of the receptacle connector 10 can be engaged with an locking edge 30 of the opening 26 in the receptacle connector 10, and the tag 28 of the tang 24 of the plug connector 14 is substantially closely positioned on the top of the distal end of the tang 18 of the receptacle connector 10 and adapted to actuate the tang 18 to move downwardly.

Therefore, when these two connectors 10 and 14 are intended to mate with other, the projecting section 12 of the receptacle connector 10 and the projecting section 16 of the plug connector 14 are moved toward each other and the projecting section 12 of the receptacle connector 10 can be generally received within the projecting section 16 of the plug connector 14. Under this procedure, the tang 18 of the receptacle connector 10 may be initially deflected downward (i.e., inward) by means that the upward tag 22 of the tang 18 confronts and is depressed by the projecting section 16 of the plug connector 14 until the tag 22 engages the locking edge 30, and then the tang 18 is finally sprung back to a flat and straight manner. Under this situation, the tag 22 of the receptacle connector 10 is latched by the locking edge 30 of the plug connector 14, so that these two connectors 10, 14 are fastened to each other.

In contrast, when releasing these two connectors 10 and 14 from each other, the tang 24 of the plug connector 14 is manually depressed downward from the exterior, and the downward tag 28 actuates a portion of the tang 18 of the receptacle connector 10 therebelow to move downward, and thus the tag 22 of the receptacle connector 10 can pass over the locking edge 30 of the opening 26 of the plug connector 14 and these two connectors 10 and 14 can be relatively moved away from each other in a direction opposite to their opposite mating direction.

Figure 1A:
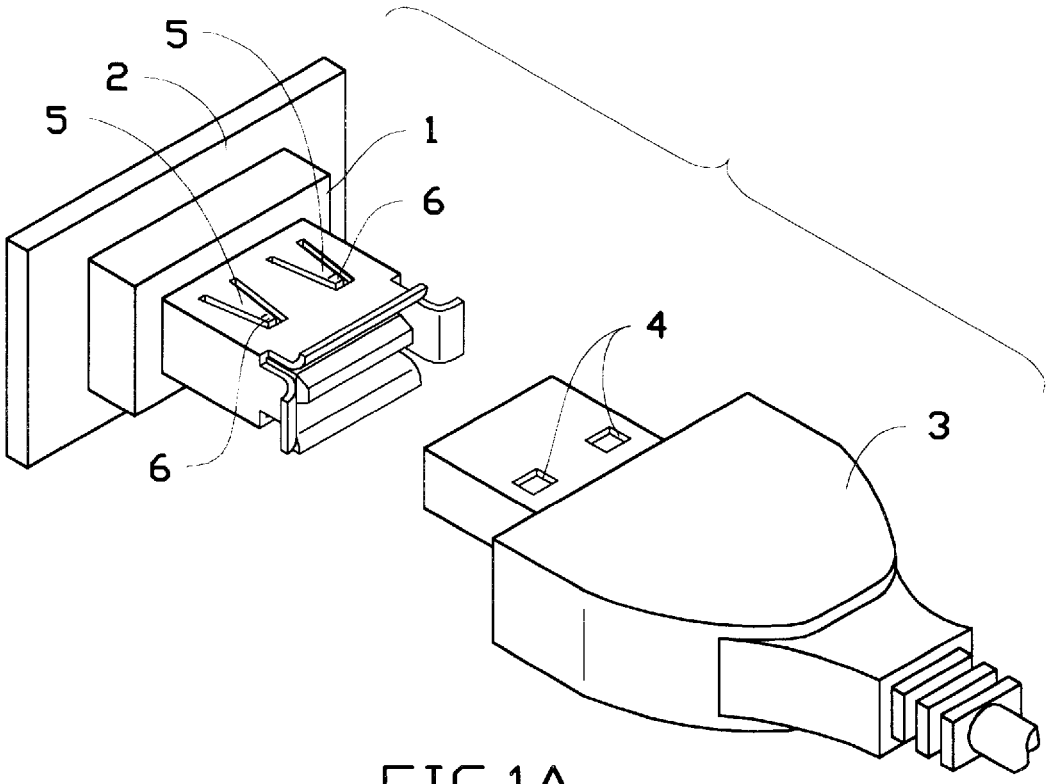
FIG. 1(A) is a perspective view of a conventional plug connector and a conventional receptacle connector adapted to mate with each other.
Figure 1B:
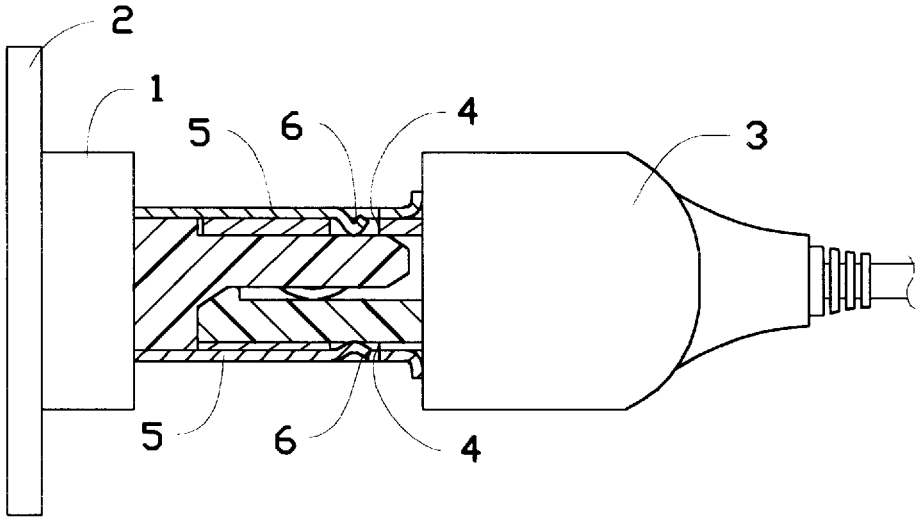
FIG. 1(B) is a cross-sectional view of the combined plug connector and receptacle connector of FIG. 1.

It can be understood that in this embodiment, the receptacle connector 10 should provide sufficient space for allowing inward movement of the tang 18, and this is substantially different from what is shown in FIGS. 1(A) and 1(B) of the prior arts.

Figure 4:
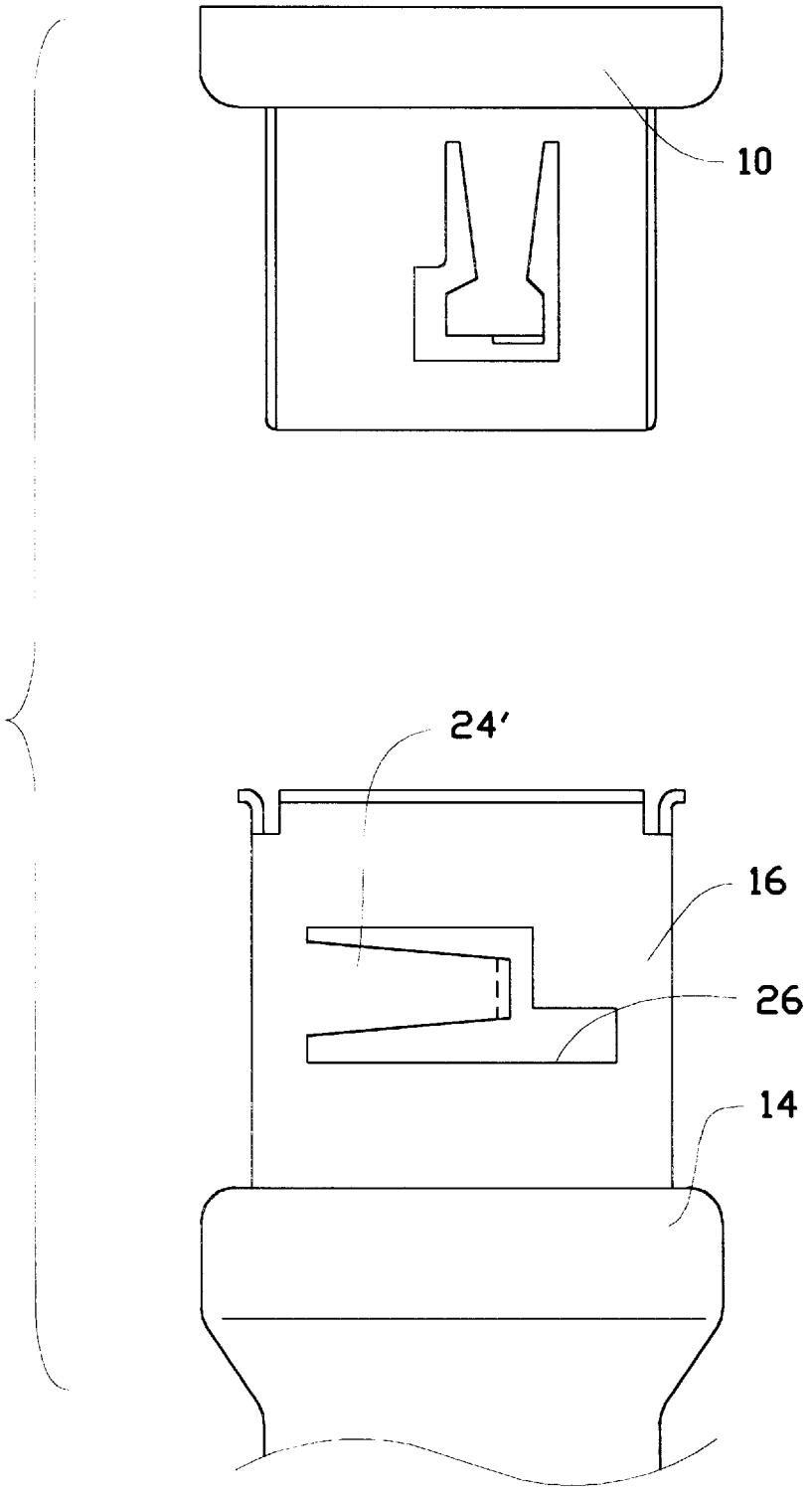
FIG. 4 is a partial view of another embodiment of the receptacle connector and the plug connector.

FIGS. 4(A) and 4(B) show another embodiment wherein the tang 24' of the plug connector 14 extends in the opening 26 in a transverse direction in place of a front-to-end direction, alternately. This is an alternate design for compliance with the arrangement of the internal components' configuration of the connectors 10 and/or 14.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claims:

1. An arrangement for combining two connectors together, comprising:

a first connector having a first projecting section with a first tang having an upward tag at a distal end thereof; and a second connector having a second projecting section with a second tang having a downward tag at a distal end thereof; whereby when the first connector and the second connector are mated with each other, the upward tag of the first tang of the first connector can be latchably engaged with a locking edge of the second connector, and the downward tag of the second tang of the second connector is substantially positioned above the first tang and ready to actuate the first tang to deflectably move downward wherein the first tang extends in a first direction perpendicular to a second direction in which the second tang extends.

2. The arrangement as described in claim 1, wherein said first tang extends in a front-to-end direction in a first opening of the first connector, and the second tang extends in the same front-to-end direction in a second opening of the second connector.

3. The arrangement as described in claim 1, wherein said first projecting section of the first connector is substantially received within the second projecting section of the second connector.

4. A connector assembly consisting of a first connector and a second connector, wherein said first connector includes a first projecting section with a latching device thereof; and said second connector includes a second projecting section forming a releasing device and an opening; whereby when said first connector and said second connector are coupled to each other, the second projecting section surrounds said first projecting section and the latching device of the first projecting section of the first connector can be locked with the opening of the second projecting section of the second connector for preventing the first connector from moving away from the second connector, and at least a portion of the releasing device of the second connector superimposes a portion of the first latching device of the first connector for being ready to actuate the latching device thereunder for detaching the first connector from the second connector.

5. The connector assembly as defined in claim 4, wherein said latching device of the first connector actuated by the releasing device of the second connector is inwardly deflected.

6. The connector assembly as defined in claim 4, wherein the latching device includes an inwardly deflectable tang with an upward tag, at a distal end thereof, which cooperates with a locking edge formed on the opening of second projecting section of the second connector to secure the first connector and the second connector together when said first and second connectors are coupled to each other.

7. The connector assembly as defined in claim 4, wherein said releasing device includes an inwardly deflectable tang with a downward tag, at a distal end thereof, which cooperates with said portion of the latching device to release the first connector from the second connector when said latching device is actuated by the releasing device of the second connector.

8. The connector assembly as defined in claim 4, wherein the releasing device extends in the opening of the second projecting section of the second connector.

* * * * *